US006539865B2

(12) United States Patent
Friedman

(10) Patent No.: US 6,539,865 B2
(45) Date of Patent: Apr. 1, 2003

(54) METHOD OF PREPARING A LITHOGRAPHIC PRINTING PLATE FOR IMAGING IN A PRINTER ENGINE

(75) Inventor: Patrick R. Friedman, Bridgewater, NJ (US)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 09/791,240

(22) Filed: Feb. 21, 2001

(65) Prior Publication Data

US 2002/0112631 A1 Aug. 22, 2002

(51) Int. Cl.[7] ..... B41C 1/10

(52) U.S. Cl. ..... 101/463.1; 101/477; 347/264; 226/92

(58) Field of Search ..... 101/382.1, 383, 101/415.1, 368, 395, 453, 463.1, 477; 428/122, 124, 192; 346/134, 135.1; 347/104, 105, 264; 355/72, 85, 97; 399/381, 388; 226/92

(56) References Cited

U.S. PATENT DOCUMENTS

| | | | | | |
|---|---|---|---|---|---|
| 3,295,443 | A | * | 1/1967 | Devon | 101/415.1 |
| 3,934,509 | A | * | 1/1976 | Saunders et al. | 101/415.1 |
| 4,408,530 | A | * | 10/1983 | Yano et al. | 101/415.1 |
| 4,744,297 | A | * | 5/1988 | Sardella et al. | 101/415.1 |
| 4,904,322 | A | * | 2/1990 | Mertens | 101/415.1 |
| 5,006,887 | A | * | 4/1991 | Ogura | 355/72 |
| 5,148,215 | A | * | 9/1992 | Shindo | 355/72 |
| 5,402,721 | A | * | 4/1995 | Schultz | 101/389.1 |
| 5,699,740 | A | | 12/1997 | Gelbart | 101/477 |
| 5,826,512 | A | | 10/1998 | Niegawa et al. | 101/454 |
| 5,947,028 | A | | 9/1999 | Montgomery et al. | 101/477 |
| 6,267,054 | B1 | * | 7/2001 | Lopes | 101/389.1 |
| 6,318,261 | B1 | * | 11/2001 | Koelsch | 101/378 |

* cited by examiner

*Primary Examiner*—Stephen R. Funk
(74) *Attorney, Agent, or Firm*—Faegre & Benson LLP

(57) ABSTRACT

A lithographic printing plate substrate is conditioned for imaging in a printer engine by attaching a leader to the leading edge. The leader is sufficiently flexible to be drawn into the printer engine and is adapted to pull the plate substrate through the printer engine.

15 Claims, 3 Drawing Sheets

METHOD OF PREPARING A LITHOGRAPHIC PRINTING PLATE FOR IMAGING IN A PRINTER ENGINE

BACKGROUND OF THE INVENTION

The present invention relates to the imaging of lithographic plates and, more particularly, to conditioning a lithographic printing plate substrate for imaging in a conventional, commercially available electrostatic printer or ink-jet printer.

Imaging of lithographic printing plates by electrostatic or ink-jet printing has been the subject of extensive research and development and has been commercialized to some extent. In the case of electrostatic imaging, a toner is applied to an electrostatic image formed on a lithographic plate substrate and is then fused. Similarly, the desired image can be formed and then fixed on a suitably prepared substrate by ink-jetting a fluid. The toner or ink-jet image on the substrate is either receptive or repellant to a printing ink, depending on the nature of the surface of the plate substrate to which the image is applied and fixed. The substrate may or may not include a coating suitable for receiving toner or ink jet fluid. An important advantage of electrostatic or ink-jet imaging is the current availability of machines (electrostatic copier/printers and ink-jet copier/printers) that can be readily adapted for use in imaging lithographic plate substrates.

Lithographic printing machines and processes require plates that are highly dimensionally stable and durable, which inherently makes them relatively thick and stiff. Currently available electrostatic and ink-jet printing engines, on the other hand, are designed to handle relatively thin, flexible materials, such as paper, thin plastic films, or metal foils. Substrates suitable for lithographic printing plates may be too stiff or thick to be reliably inducted into and transported in many available printing engines.

SUMMARY OF THE INVENTION

An object of the present invention is to provide an article suitable for imaging in currently available electrostatic and ink-jet printer engines to make a lithographic printing plate. More particularly, it is an object to condition a lithographic plate substrate so that it will be reliably inducted and transported by the sheet-transports of such printer engines. It is also an object to provide a plate substrate that is conditioned in a very simple, economical and effective way to feed through printer engines for imaging.

As used hereinafter, the term "printer engine" means an apparatus that is capable of transporting sheet material and forming an image on the sheet material by placing a substance on the sheet material by electrostatic or ink-jet deposition.

The objects referred to above are attained, in accordance with the present invention, by an article for use in preparing a lithographic printing plate by imaging in a printer engine. The article includes a lithographic plate substrate and a leader attached to and projecting from a leading edge of the plate substrate, the leader being sufficiently flexible to be drawn into the printer engine and being adapted to pull the plate substrate through the printer engine.

It has been found that even though many presently available printer engines may not accept and transport the relatively thick and rigid plate substrates required by lithographic printing machines for durability, such plate substrates will transport properly and reliably with a leader according to the invention. The leader may be of any thin material that will itself (without the plate substrate that is to be imaged) be picked up and transported by the printer engine. The leader need not itself be especially durable, because it need only "lead" the plate substrate through the printer engine and will be removed after the plate substrate is imaged. The provision and use of the leader involves a comparatively negligible cost and avoids the need for the costly development and production of special printer engines for imaging lithographic plates.

The plate substrate may be of a high-density polymeric material, a coated paper, or a metal, such as aluminum, tin or copper. The leader may be paper, a film of a polymeric material, or a thin metal film or plate substrate. In the case of electrostatic imaging, the leader must be of a material that will not melt during fusing of the toner. The leader may be attached to the plate substrate by an adhesive, which may be a self-sticking adhesive that is detachable from the plate substrate without marring the plate substrate or an adhesive that aggressively and more or less permanently attaches the leader to the plate substrate. In the latter case, the leader is severed from the plate substrate after the plate substrate has been imaged.

The leader may be a strip of material having a portion overlapping the plate substrate and may be attached to the plate substrate by an adhesive on the overlapping portion. It is also possible for the leader to be a strip of material forming a butt joint with the leading edge of the plate substrate and attached to the plate substrate by a band of an adhesive tape on one side or bands of adhesive tape on both sides.

In a particularly desirable embodiment, the leader is a strip of an adhesive tape having a portion overlapping and adhered to the plate substrate and a portion extending from the leading edge of the plate and doubled back on itself such that a free edge of the doubled back portion forms a butt joint with the leading edge of the plate substrate. The adhesive tape may be a paper adhesive tape, which provides a desirable surface for induction and transport by the printer engine and avoids any possible problem of melting or softening in the fuser of an electrostatic printer engine.

The leader may project from the leading edge of the plate substrate by a distance of from 0.125 inch to 10 inches. The amount of the projection will depend on the sheet-transport structure of a particular printer engine. It has been found generally that a projection of about 0.5 to 1.0 inch is sufficient. It is usually desirable that the leader be substantially coextensive widthwise with the leading edge of the plate substrate.

The foregoing description has outlined rather broadly some features and advantages of the present invention. The detailed description of embodiments of the invention that follows will enable the present invention to be better understood and the present contribution to the art to be more fully appreciated. Those skilled in the art will recognize that the embodiments may be readily utilized as a basis for modifying or designing other structures and methods for carrying out the purposes of the present invention. All such structures and methods are intended to be included within the spirit and scope of the invention as set forth in the appended claims.

DESCRIPTION OF THE EMBODIMENTS

Figure 1:
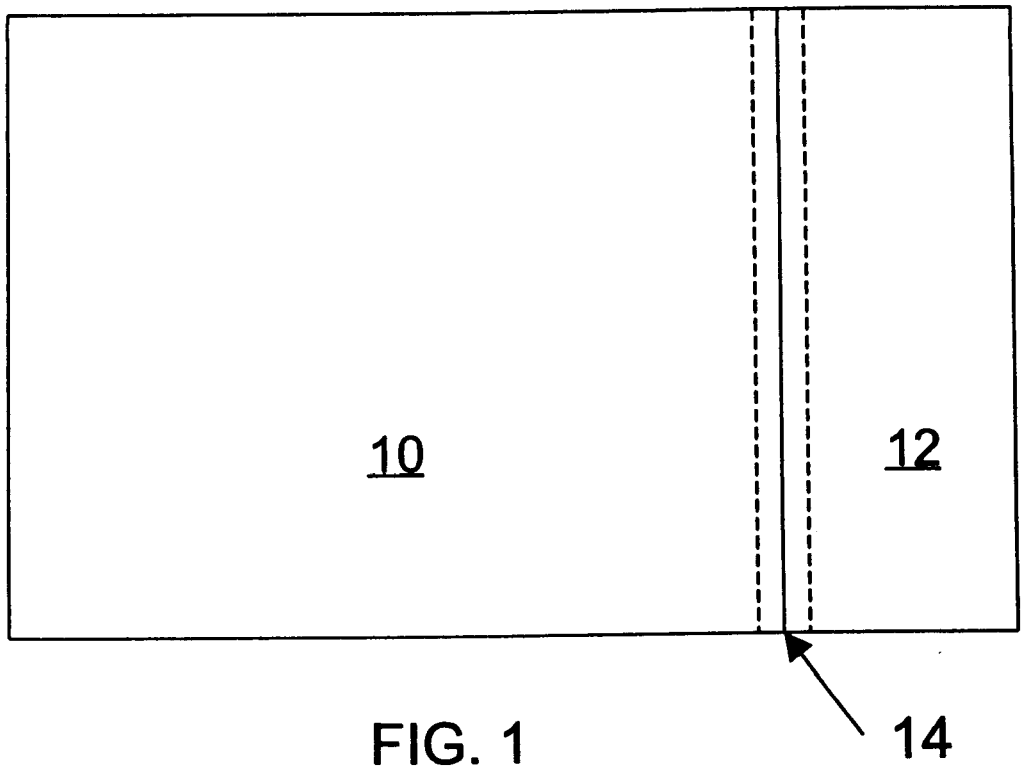
FIG. 1 is a plan view of an article according to a first embodiment of the present invention.

In the illustrated embodiments, the reference numeral 10 designates a lithographic printing plate substrate, which may be of any suitable durable material and prepared in any suitable manner to have a surface that rejects a lithographic printing ink and on which an image can be formed and fixed by deposition of a substance that accepts the printing ink. Other substrate configurations are possible and will be well known to those skilled in the art. For example, it is possible for waterless printing to have a substrate that accepts ink and to deposit an oleophobic background material via ink jet or electrostatic processes. Substrates of polymeric materials, coated paper, and metals, such as aluminum, tin and copper, with suitable surfaces are well-known. The substrate 10 is trimmed to a desired size and is rectangular. For durability, a substrate having an aluminum sheet base, which may be of 4, 6 or 8 gauge, is advantageous.

Figure 2:
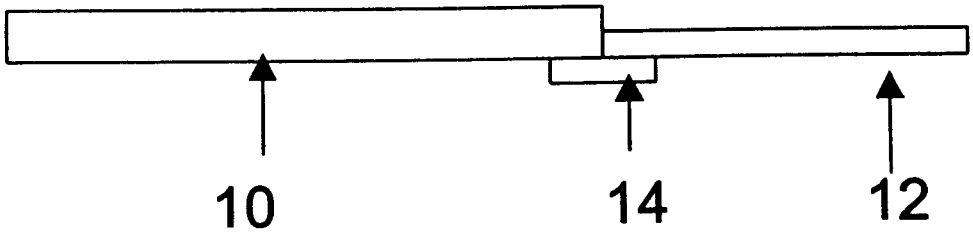
FIG. 2 is a side elevational view of a portion of the first embodiment.

In the first embodiment (FIGS. 1 and 2), a leader 12 in the form of a strip of material, which may be any material that by itself (without the printing plate substrate) can be inducted into and transported through a printer engine, is attached to the substrate 10 by a band 14 of an adhesive tape. Suitable materials for the leader 12 include paper, polymeric films, and metal foils. The leader 12 forms a butt joint with the leading edge of the substrate 10, and the tape is applied to the back faces of the substrate 10 and the leader 12. A suitable tape 14 is a paper tape with an adhesive that enables the tape to be removed from the substrate 10 without marring or leaving a residue on the substrate. A paper tape is not subject to melting in the fuser of an electrostatic printer.

Figure 3:
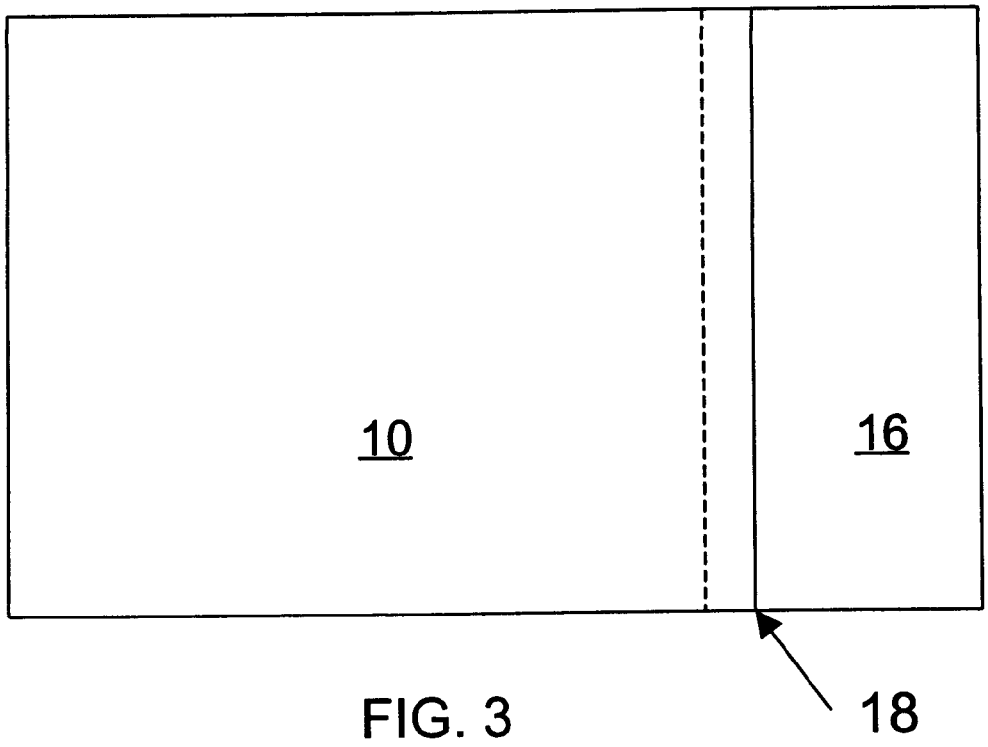
FIG. 3 is a plan view of an article according to a second embodiment of the present invention.
Figure 4:
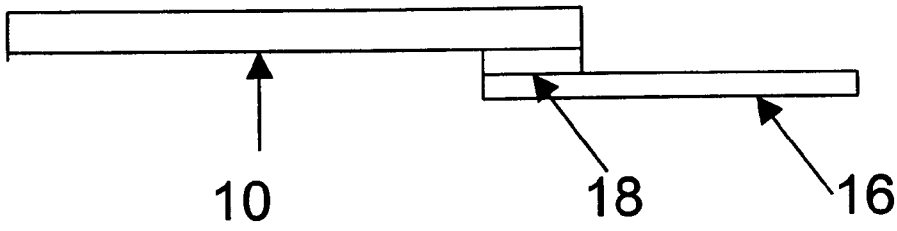
FIG. 4 is a side elevational view of a portion of the second embodiment.

In the embodiment of FIGS. 3 and 4, a leader 16 of a suitable material has a band 18 of an adhesive applied along one edge. The portion of the leader 16 bearing the adhesive is applied in overlapping relation to the underside of the leading edge of the substrate 10. The adhesive band 18 secures the leader to the substrate 10. The adhesive may be of a type that is readily stripped from the substrate or it may be of a type, such a contact type, that strongly secures the leader to the substrate. In the latter case, the part of the leader that projects from the free edge of the substrate 10 can be cut off after the leader has served its purpose.

Figure 5:
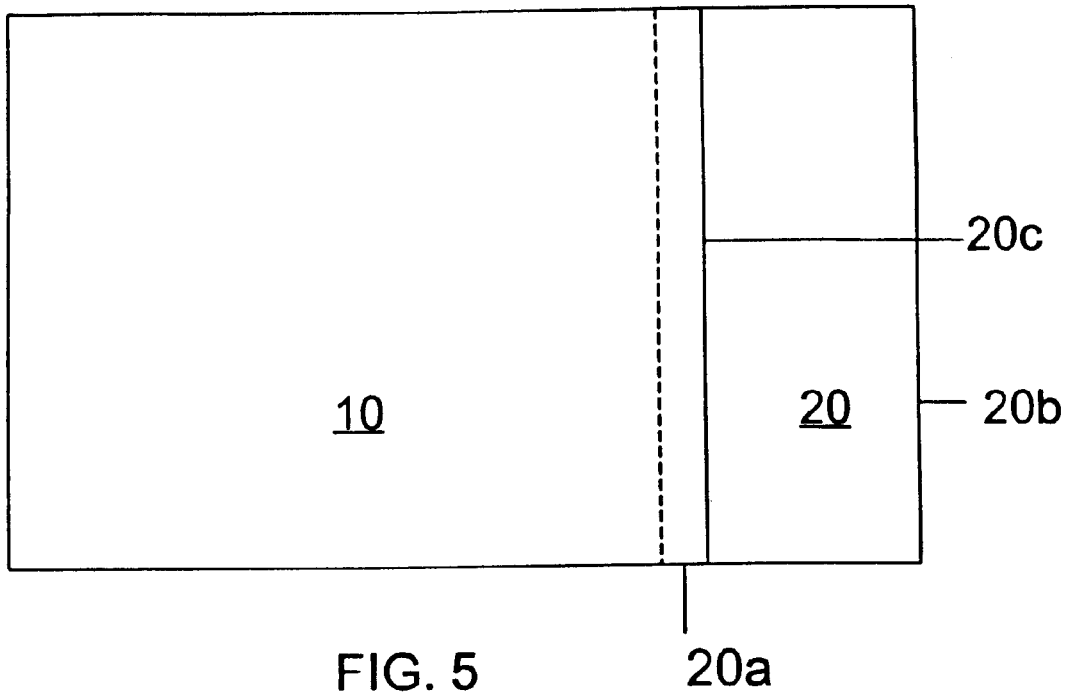
FIG. 5 is a plan view of an article according to a third embodiment of the present invention.
Figure 6:
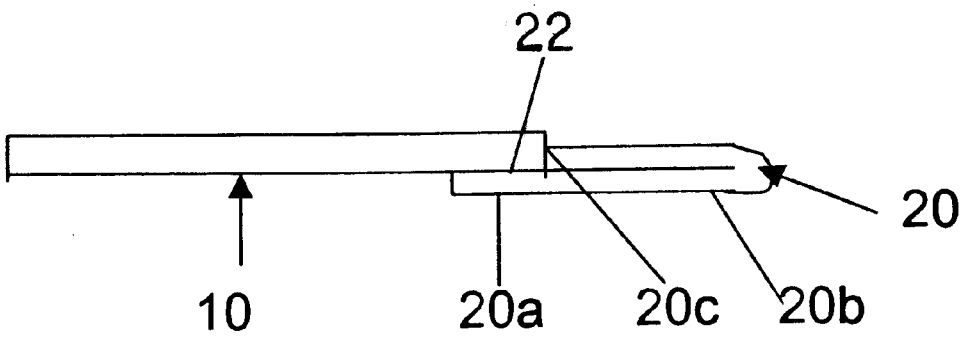
FIG. 6 is a side elevational view of a portion of the third embodiment.

FIGS. 5 and 6 show an especially simple and effective conditioning of the substrate 10 for induction into and transport through a printer engine. An edge portion 20*a* of a band 20 of an adhesive tape, which has a paper base and a self-sticking adhesive layer 22 over the entirety of one surface of the base, is applied to the underside of the plate substrate. The free end portion 20*b* of the band 20 is folded back on itself to form a double layer, in which the overlapping layers adhere to each other. The free edge 20*c* of the tape band 20 forms a butt joint with the leading edge of the substrate 10. After imaging in a printer engine, the tape band is peeled away from the plate substrate.

Various aspects of the particular applications of the present invention are subject to routine experimentation with specific printer engines. For example, the amount of projection of the leader from the free edge of the substrate will vary from printer to printer. The materials of the adhesive and the leader should be selected in advance with attention to the effects of heat in the case of electrostatic printers. Generally, the leader should be coextensive widthwise with the substrate, but some printer engines may work perfectly well with leaders that extend less than the full width of the substrate. The tenacity of the adhesive generally need only be sufficient to ensure reliable induction into and feed of the substrate through the printer engine without detachment of the leader.

What is claimed is:

1. A method of preparing a lithographic printing plate substrate for imaging in a printer engine, comprising the steps of providing a plate substrate of a dimensionally stable material comprising a leader in an extending relation to a leading edge of the plate substrate, the leader being sufficiently flexible to be drawn into the printer engine and being adapted to pull at least the leading edge of the plate substrate into the printer engine;

feeding the leader into the print engine to draw the plate substrate through the printer engine;

applying an image to the plate substrate as it is drawn through the printer engine.

2. The method according to claim 1, wherein the plate substrate is a member selected from the group consisting of high-density polymeric materials, coated papers, and metals.

3. The method according to claim 1, wherein the leader is a member selected from the group consisting of paper, films of polymeric materials, and thin metal strips.

4. The method according to claim 1, the leader is substantially coextensive widthwise with the leading edge of the plate substrate.

5. The method according to claim 1, wherein the leader is attached to the plate substrate by an adhesive.

6. The method according to claim 5, wherein the adhesive is detachable from the plate substrate without marring the plate substrate.

7. The method according to claim 1, wherein the leader is a strip of material having a portion overlapping the plate substrate and is attached to the plate substrate by an adhesive on the overlapping portion.

8. The method according to claim 1, wherein the leader is a strip of material forming a butt joint with the leading edge of the plate substrate and is attached to the plate substrate by a band of an adhesive tape.

9. The method according to claim 1, wherein the leader projects from the leading edge of the plate substrate by a distance of from 0.125 inch to 10 inches.

10. The method according to claim 1, wherein the leader is a strip of an adhesive tape having a portion overlapping and adhered to the plate substrate and a portion extending from the leading edge of the plate and doubled back on said leader such that a free edge of the doubled back portion forms a butt joint with the leading edge of the plate substrate.

11. The method according to claim 10 wherein the adhesive tape has a paper base.

12. The method according to claim 1 wherein the print engine is an electrostatic imaging device and the image is applied with toner particles.

13. The method of claim 12 further comprising fixing the electrostatically applied toner particles to the plate substrate following the particle application by the printer engine.

14. The method according to claim 1 wherein the print engine is an inkjet printer and the image is applied with a ink jettable liquid.

15. The method of claim 14 wherein the ink jetted liquid is fixed to the plate substrate after application by the printer engine.

* * * * *